United States Patent [19]

Horodysky

[11] 4,382,006

[45] May 3, 1983

[54] FRICTION REDUCTION ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 255,914

[22] Filed: Apr. 20, 1981

Related U.S. Application Data

[63] Continuation-in-part of Ser. No. 91,903, Nov. 6, 1979, abandoned.

[51] Int. Cl.[3] ..... C10M 1/32

[52] U.S. Cl. ..... 252/49.6; 252/51.5 R; 252/389 R; 252/33.6

[58] Field of Search ..... 252/49.6, 49.7, 51.5 R, 252/33.6, 389 R

[56] References Cited

U.S. PATENT DOCUMENTS

| | | | |
|---|---|---|---|
| 3,185,644 | 5/1965 | Knowles | 252/49.6 |
| 3,645,901 | 2/1972 | Matson | 252/49.6 |
| 4,176,076 | 11/1979 | Waldstein | 252/49.6 |
| 4,204,972 | 5/1980 | Knoblauch et al. | 252/78.1 |
| 4,226,734 | 10/1980 | Schuster | 252/49.3 |

*Primary Examiner*—Jacqueline V. Howard

*Attorney, Agent, or Firm*—Charles A. Huggett; Michael G. Gilman; Howard M. Flournoy

[57] ABSTRACT

Ethoxylated amines and their borated derivatives are effective friction modifying additives when incorporated into various hydrocarbyl lubricants. In general the borated derivatives possess superior friction modifying capability.

13 Claims, No Drawings

FRICTION REDUCTION ADDITIVES AND COMPOSITIONS THEREOF

CROSS-REFERENCE TO RELATED APPLICATIONS

This application is a Continuation-in-Part of Ser. No. 091,903 filed Nov. 6, 1979 and now abandoned.

BACKGROUND OF THE INVENTION

This invention is directed to ethoxylated lubricant additives having utility as friction modifiers and to lubricant compositions containing same. This invention more particularly is directed to borated adducts of the ethoxylated amines. The invention further relates to a method of reducing fuel consumption in automotive engines, and other lubricated systems.

DISCUSSION OF THE PRIOR ART

A major concern today is finding viable ways to reduce fuel consumption in internal combustion engines. One means is to treat moving parts of such engines with lubricants containing friction reducing additives. Considerable work has been done in this area.

Amines and derivatives thereof have found widespread use as lubricating additives, e.g., antioxidants. However, it has now been found that certain ethoxylated amines and borated adducts thereof can impart friction modifying characteristics to lubricating oils when incorporated therein. So far as is known the use of additives in accordance with this invention as friction modifiers has not been previously known or suggested in the prior art.

SUMMARY OF THE INVENTION

The present invention is directed to ethoxylated compounds and the borated derivatives thereof useful as friction modifying additives for various organic fluids. Such fluids may comprise liquid and solid media such as oils of lubricating viscosity or solid lubricants such as greases prepared therefrom.

The ethoxylated additive compounds of this invention have the following generalized structure:

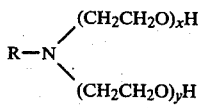

where R is a hydrocarbyl group having from about 10 to about 30 carbon atoms and can be alkyl, aryl, alkaryl, alkenyl, etc. and x and y may be the same or different and each is an integer from about 1 to 10 and preferably 1 to 5. The sum of x and y must be at least 2. Accordingly the ethoxylated amines described herein are generally speaking tertiary amines having one alkyl group and two or more polyoxyethylene groups attached to the nitrogen.

The ethoxylated amines may be obtained from normal commercial sources or prepared as follows: Generally the ethoxylated amines may be prepared by the reaction of the appropriate hydrocarbyl amine with ethylene oxide, often catalyzed, to form the corresponding ethoxylated amine.

Included among suitable ethoxylated amines are bis(2-hydroxyethyl) oleylamine, polyoxyethylene (5) oleylamine, bis(2-hydroxyethyl) cocoamine, polyoxyethylene (5) cocoamine, bis(2-hydroxyethyl) soyamine and bis(2-hydroxyethyl) octadecylamine, etc.

The borated derivatives are prepared by treating readily available ethoxylated amines with boric acid, preferably in an alcoholic or hydrocarbon solvent. The presence of a solvent is not essential, however, if one is used it may be reactive or non-reactive. Suitable non-reactive solvents include benzene, toluene, xylene and the like. Suitable reactive solvents include isopropanol, butanol, the pentanols and the like. Reaction temperatures may vary from about 70° to 250° C. with 110° to 170° C. being preferred. Reaction time is not critical but depending upon temperature, etc., it may vary from about 1–2 hours up to about 15 hours. Generally stoichiometric amounts of boric acid are used, however amounts in excess of this can be used to obtain compounds of varying degrees of boration. In this regard see Examples 8 to 11 below where Example 11 has about 2½ times the boron content of Example 8. Boration levels can therefore vary in the instant compounds from about 0.05 to about 7 wt. %. Other methods are also available to make similar borated derivatives. The ethoxylated amines may accordingly be borated by any means known to the art, for example, through transesterification with a trialkyl borate such as tributyl borate. This reaction is often carried out in the presence of boric acid. In general borated adducts of the described ethoxylated amines possess even greater friction reducing properties than similar non-borated derivatives. For example, aslittle as 0.25 wt. % of a borated ethoxylated amine may reduce friction of a fully blended automotive engine oil by as much as 22–24%. It is noted that the borated derivatives not only provide improved oxidative stability but also improve copper corrosion inhibition.

The lubricants contemplated for use herein include both mineral and synthetic hydrocarbon oils of lubricating viscosity, mixtures thereof and greases prepared therefrom. The synthetic hydrocarbon oils include long chain alkanes such as cetanes and olefin polymers such as trimer and tetramers of octene and decene. These synthetic oils can be mixed with (1) ester oils such as pentaerythritol esters of monocarboxylic acids having about 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from 1 to 20 carbon atoms, or mixtures of such acids. Also preferred are ester fluids made from trimethylolpropane and an aliphatic monocarboxylic acid containing from 1 to 20 carbon atoms, or mixtures of such acids.

The amount of additive compound in the lubricant will usually range from about 0.1% to about 10% by weight of said lubricant, preferably from about 0.25 to about 5% by weight.

The use of additive quantities of the instant surface active amines and borated adducts thereof results in a significant reduction of friction and thereby provides a method for reducing fuel consumption in an internal combustion engine by treating the moving surfaces thereof with a composition comprising a major proportion of an oil of lubricating viscosity and a minor effective friction reducing amount of the instant additive compounds.

Having described the invention in general terms, the following examples are offered to specifically illustrate the invention. It is to be understood that they are illustrations only and that the invention is not thereby limited except as by the appended claims.

DESCRIPTION OF SPECIFIC EMBODIMENTS

Certain ethoxylated and polyethoxylated amines were blended into a fully formulated 5W-20 automotive engine oil containing a dispersant/detergent/inhibitor package having the following general properties:

Kinematic Viscosity @ 100° C.-6.8 cs @ 40°-36.9
Viscosity Index-143

Thereafter they were evaluated using the Low Velocity Friction apparatus (LVFA).

The test compounds were either obtained commercially or prepared as described below:

EXAMPLE 1

Bis(2-hydroxyethyl) oleylamine. This clear orange liquid was commercially obtained and had a combining weight of approximately 350. The tertiary amine content was greater than 95% and contained 2 moles of ethylene oxide. The specific gravity was approximately 0.90. The primary plus secondary amine content was approximately 3%.

EXAMPLE 2

Polyoxyethylene (5) oleylamine. This clear liquid was commercially obtained and had a combining weight of approximately 500. The amine contained approximately 5 moles of ethylene oxide and had a specific gravity of approximately 0.96.

EXAMPLE 3

Bis(2-hydroxyethyl) cocoamine. This clear liquid was commercially obtained and has a combining weight of about 285. The tertiary amine content was greater than 96% and the primary plus secondary amine content was less than 2%. The amine contained 2 moles of ethylene oxide and had a specific gravity of about 0.87.

EXAMPLE 4

Polyoxyethylene (5) cocoamine. This clear liquid was commercially obtained and had a combining weight of about 420. The primary plus secondary amine content was less than 2% and the amine contained about 5 moles of ethylene oxide. The specific gravity was approximately 0.98.

EXAMPLE 5

Bis(2-hydroxyethyl) soyamine. This clear liquid was commercially obtained and had a combining weight of about 350. The tertiary amine content was greater than 96% and the primary plus secondary amine content was less than 3%. The amine contained about 2 moles of ethylene oxide and possessed a specific gravity of approximately 0.91.

EXAMPLE 6

Bis(2-hydroxyethyl) octadecylamine. This solid amine was commercially obtained and had a combining weight of approximately 360. The tertiary amine content was greater than 96% and the primary plus secondary amine content was less than 3%. The amine contained about 2 moles of ethylene oxide and had a specific gravity of about 0.96.

EXAMPLE 7

Borated bis(2-hydroxyethyl) oleylamine. Approximately 170 g. of bis(2-hydroxyethyl) oleylamine described in Example 1 was charged to a 1l glass reactor fitted with an agitator, thermometer, Dean-Stark tube and condenser. Agitation was begun and 69 g. of butanol and 16 g. of boric acid were added. The mixture was heated. Water evolution was noticed at about 120° C. After a 5-hour heating period up to 165° C., more than 11 ml. of water was collected. The solvent was then removed by vacuum distillation and the product was cooled to below 90° C. and filtered. The product was an orange liquid possessing no strong amine odor:

Analysis: Nitrogen, wt. %-3.8 Oxygen, wt. %-7.9 Boron, wt. %-1.2

EXAMPLE 8

A second sample of borated bis(2-hydroxyethyl) oleylamine was prepared as follows: Approximately 3150 g. of bis(2-hydroxyethyl) oleylamine described in Example 1 was reacted with 362 g. of boric acid and 444 g. butanol as described in Example 7. The evolution of water was noted at 110° C. and the reaction mixture was held at 130°-145° C. for a total of 7 hours. More than 305 g. of water was collected and the solvent was removed by vacuum distillation and the product was filtered to yield a clear orange liquid:

Analysis: Nitrogen, wt. %-3.9 Oxygen, wt. %-6.6 Boron, wt. %-1.1

EXAMPLE 9

A third sample of borated bis(2-hydroxyethyl) oleylamine was prepared as follows: Approximately 3150 g. of bis(2-hydroxyethyl) oleylamine described in Example 1 was reacted with 543 g. of boric acid using 300 g. of toluene as solvent in a manner similar to Examples 7 and 8. After a 6-hour reaction period at up to 160° C. a total of 420 ml. water was collected. The toluene solvent was recovered by vacuum distillation and the relatively clear orange liquid was filtered.

Analysis: Nitrogen, wt. %-3.9 Oxygen, wt. %-5.8 Boron, wt. %-1.6

EXAMPLE 10

An additional sample of borated bis(2-hydroxyethyl) oleylamine was prepared as follows: Aproximately 3150 g. of bis(2-hydroxyethyl) oleylamine described in Example 1 was reacted with 485 g. of boric acid using 300 g. of toluene and 75 g. butanol as solvents as per Example 9. After a 5½ hour reaction period at temperatures up to 155° C., a total of 391 ml. of water was collected. The solvents were removed by vacuum distillation and the relatively clear orange liquid was filtered.

Analysis: Nitrogen, wt. %-3.8 Oxygen, wt. %-5.4 Boron, wt. %-1.8

EXAMPLE 11

An additional sample of borated bis(2-hydroxyethyl) oleylamine was prepared as follows: Approximately 3150 g. of bis(2-hydroxyethyl) oleylamine described in Example 1 was reacted with 813 g. boric acid and 200 g. toluene and 30 g. butanol as per Example 9. After a 7½ hour reaction period using temperatures up to 170° C., a total of 504 ml. water was collected. The solvents were removed by vacuum distillation and the relatively clear orange viscous liquid was filtered hot.

EXAMPLE 12

Borated bis(2-hydroxyethyl) cocamine. Approximately 315 g. of bis(2-hydroxyethyl) cocoamine was charged to a 1 l. reactor along with 50 g. boric acid, 80 g. toluene and 8 g. butanol and reacted in a manner similar to that described in Example 7. After a 4½ hour reaction period at temperatures up to 145° C., a total of 38 ml. of water was collected. The solvents were removed by vacuum distillation and the relatively clear orange liquid was filtered.

Analysis: Nitrogen–4.8% Oxygen–7.1% Boron–2.5%

EXAMPLE 13

Borated bis(2-hydroxyethyl) soyamine. Approximately 274 g. of bis(2-hydroxyethyl) soyamine was reacted with 54 g. boric acid, 80 g. toluene and 8 g. butanol in a manner similar to that described in Example 7. After a 5-hour reaction period at temperatures up to 145°, a total of 42 ml. of water was collected. The solvents were removed by vacuum distillation and the relatively clear liquid was further clarified by filtration.

Analysis: Nitrogen–3.8% Oxygen–6.2% Boron–2.1%

EVALUATION OF THE PRODUCT

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 teel surface (diam. 1.5 in.) which is attached to a drive shaft and rotated over a stationary, raised, narrow ringed SAE 1020 steel surface (area 0.08 in$^2$). Both surfaces are submerged in the test lubricant. Friction between the steel surfaces is measured as a function of the sliding speed at a lubricant temperature of 250° F. The friction between the rubbing surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 30 fpm sliding speed. Freshly polished steel specimens are used for each run. The surface of the steel is parallel ground to 4 to 8 microinches.

The test data are shown in Table 1 (ethoxylated amines) and Table 2 (borated ethoxylated amines). The base oil is a lubricating oil as described above. The percentages by weight are percentages by weight of the total lubricating oil composition, including the usual additive package. The data are percent decrease in friction according to:

$$\frac{(U_k \text{ of oil alone}) - (U_k \text{ of additive plus oil}) \times 100}{(\text{Friction of oil alone})}$$

Thus, the corresponding value for the oil alone would be zero for the form of the data used.

TABLE 1

| Example No. | Additive Con. Wt. % | Reduction or Percent Change in Coefficient of Friction 5 Ft./Min. | 30 Ft./Min. |
|---|---|---|---|
| 1 | 4 | 39 | 33 |
| | 2 | 30 | 29 |
| | 1 | 25 | 18 |
| 2 | 4 | 25 | 23 |
| 3 | 4 | 36 | 38 |
| 4 | 4 | 30 | 31 |
| 5 | 4 | 39 | 35 |
| 6 | 4 | 45 | 38 |
| Base Oil | — | 0 | 0 |

TABLE 2

| Example No. | Additive Con. Wt. % | Reduction or Percent Change in Coefficient of Friction 5 Ft./Min. | 30 Ft./Min. |
|---|---|---|---|
| 7 | 4 | 46 | 40 |
| | 2 | 48 | 35 |
| | 1 | 43 | 32 |
| | 0.5 | 33 | 26 |
| | 0.25 | 24 | 22 |
| 8 | 1 | 42 | 31 |
| 9 | 2 | 34 | 24 |
| | 1 | 43 | 32 |
| | 0.5 | 39 | 28 |
| 10 | 1 | 40 | 30 |
| | 0.5 | 28 | 22 |
| 11 | 1 | 32 | 27 |
| 12 | 4 | 32 | 25 |
| | 2 | 35 | 38 |
| 13 | 4 | 43 | 32 |
| | 2 | 30 | 27 |

Examination of the test data reveals significant reductions in the coefficient of friction, with as stated supra some of the borated derivatives being more effective at lower concentrations than the non-borated ethoxylated amines of this invention. The use of low concentrations of these readily available friction-modifying additives in accordance herewith also improves the fuel economy characteristics of engines treated with lubricants containing same.

To illustrate that the additive products obtained in accordance with the invention as presently claimed are surprisingly superior to the prior art in general, the following exemplary products were prepared in the manner described below. Data with respect thereto is as detailed in Table 3 below.

EXAMPLE A

Preparation of borated 2-hydroxyethyl oleylamine (x+y=1) (oleyl—N—$CH_2CH_2OH$)

Charge 152 g 2-hydroxyethyl oleylamine, 42 g boric acid and 50 g toluene as solvent to a glass reactor fitted with agitator and Dean-Stark tube. Heat up to 160° C. until no more water azeotropes over into the Dean-Stark tube. Cool to below 100° C. and filter through Diatomaceous earth. The product was a clear fluid.

EXAMPLE B

Example 1 of Knowles et al 3,185,644 duplicated.

Preparation of N,N-diethylaminoethylate borotrimethylate 234 g N,N-diethylaminoethanol were added to 207 g, trimethyl-borate, the pot temperature rose to 30° C. The reaction product was a clear water-white liquid.

Oil blends of A and B were made for evaluation as friction modifiers as described in the above identified application on pages 10 to 12. The friction reducing properties of Examples A and B were accordingly evaluated in a manner identical to that described for Example 7 (see page 7 of specification for its preparation).

TABLE 3

| | Additive Con. Wt. % | Reduction or Percent Change Coefficient of Friction* 5 Ft. /Min. | 30 Ft. /Min. |
|---|---|---|---|
| Example 7 | 1 | 43 | 32 |
| [borated bis(2-hydroxyethyl) | 0.5 | 33 | 26 |
| oleylamine] x + y = 2 | 0.25 | 24 | 22 |
| $(\text{oleyl-N}(CH_2CH_2OH)_2\ \text{borated})$ | | | |
| Example A | 1 | 4 | 3 |
| borated 2-hydroxyethyl oleylamine (oleyl-N—$CH_2CH_2OH$ borated) x + y = 1 where x or y = 0 | | | |
| Example B | 1 | 4 | 3 |
| Example 1 of U.S. Pat. No. 3,185,644, Knowles et al N,N—diethylaminoethylate borotrimethylate | | | |

*Example A is a product made and wherein x + y = 1.

Therefore, it is clearly obvious that when X+Y=2 or more, the lubricant products are novel and show unexpected friction reducing properties in lubricant compositions over prior art U.S. Pat. No. 3,185,644. At 1 wt. % conc. in base oil, Example A and B where x+y=1, show no real friction reducing properties. However, at 1% conc., Example 7 shows a 43 to 32% reduction in friction. The superiority is such that even 0.25% of Example 7 shows a 24 to 22% reduction in friction while based on the above data the prior art (Knowles et al) would show apparently no friction reducing characteristics at this concentration level.

Example B is a product made substantially in accordance with the procedure of Example 1 of U.S. Pat. No. 3,185,644.

Example 7 is a product made in accordance with the present invention (Example 7, page 8).

What is claimed is:

1. A lubricant composition comprising a major proportion of an oil of lubricating viscosity or grease prepared therefrom and a minor friction reducing proportion of a borated adduct of a compound having the following generalized structure:

$$R-N\begin{matrix}(CH_2CH_2O)_xH\\(CH_2CH_2O)_yH\end{matrix}$$

where R is a hydrocarbyl group containing from 10 to about 30 carbon atoms, where x is an integer from 1 to 10; where y is an integer from 1 to 10, and the sum of x and y is at least 2, and where x and y may be the same or different.

2. The composition of claim 1 wherein the additive compound is borated bis(2-hydroxyethyl) oleylamine.

3. The composition of claim 1 wherein the additive compound is borated bis(2-hydroxyethyl) cocamine.

4. The composition of claim 1 wherein the additive compound is borated bis(2-hydroxyethyl) soyamine.

5. The composition of claim 1 wherein the additive compound is borated bis(2-hydroxyethyl) octadecylamine.

6. The composition of claim 1 having from 0.1 to 10 wt. % of the additive compound.

7. The composition of claim 6 having from 0.25 to 4 wt. % of the additive compound.

8. The composition of claim 1 wherein the oil of lubricating viscosity is a mineral or synthetic oil.

9. The composition of claim 8 wherein said oil is a mineral oil.

10. The composition of claim 8 wherein said oil is a synthetic oil.

11. The composition of claim 1 wherein said lubricant composition is a grease or other solid lubricant.

12. A method for reducing fuel consumption in an internal combustion engine by treating the moving surfaces thereof with a composition comprising a major amount of an oil of lubricating viscosity containing a minor friction reducing or fuel reducing amount of an additive compound as described in claim 1.

13. The composition of claim 1 where R is selected from the group consisting of alkyl, aryl, alkaryl and alkenyl.

* * * * *